US009305511B2

(12) United States Patent
Ma et al.

(10) Patent No.: US 9,305,511 B2
(45) Date of Patent: Apr. 5, 2016

(54) COMMON ELECTRODE VOLTAGE COMPENSATING METHOD, APPARATUS AND TIMING CONTROLLER

(71) Applicants: HEFEI BOE OPTOELECTRONICS TECHNOLOGY CO., LTD., Hefei, Anhui (CN); BOE TECHNOLOGY GROUP CO., LTD., Beijing (CN)

(72) Inventors: Tao Ma, Beijing (CN); Hengbin Li, Beijing (CN)

(73) Assignees: HEFEI BOE OPTOELECTRONICS TECHNOLOGY CO., LTD., Hefei, Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 105 days.

(21) Appl. No.: 13/962,211

(22) Filed: Aug. 8, 2013

(65) Prior Publication Data

US 2014/0085345 A1 Mar. 27, 2014

(30) Foreign Application Priority Data

Sep. 27, 2012 (CN) ..... 2012 1 0372009

(51) Int. Cl.
*G09G 3/36* (2006.01)

(52) U.S. Cl.
CPC ..... *G09G 3/3696* (2013.01); *G09G 3/3614* (2013.01); *G09G 3/3655* (2013.01); *G09G 2360/16* (2013.01)

(58) Field of Classification Search
CPC . G09G 3/3614; G09G 3/3696; G09G 3/3655; G09G 2360/16
See application file for complete search history.

(56) References Cited

U.S. PATENT DOCUMENTS 6,989,845 B1 * 1/2006 Okamoto et al. ..... 345/691
2009/0066627 A1 * 3/2009 Yin ..... 345/94

(Continued)

FOREIGN PATENT DOCUMENTS

CN 101127195 A 2/2008
CN 102243849 A 11/2011

(Continued)

OTHER PUBLICATIONS

Extended European Search Report Dated Nov. 22, 2013 Appln. No. EP 13 17 9441.
First Chinese Office Action Dated Mar. 26, 2014 Appln. No. 201210372009.6.

(Continued)

*Primary Examiner* — Vijay Shankar
*Assistant Examiner* — Cory Almeida
(74) *Attorney, Agent, or Firm* — Ladas & Parry LLP

(57) ABSTRACT

A common electrode voltage compensating method, apparatus and a timing controller, the method comprising making statistics for grey scale data of every pixel for displaying a display picture; calculating a grey scale shifting rate between two adjacent rows of pixels, and obtaining common electrode voltage compensation signal parameters based on the grey scale shifting rate; generating positive/negative polarity information of the common electrode voltage compensation signal parameters based on a pixel voltage polarity inversion signal; generating a common electrode voltage compensation control signal based on the common electrode voltage compensation signal parameters and the positive/negative polarity thereof. The common electrode voltage compensating method, apparatus and timing controller address the problem of display picture pixels grey scale shifting due to a reversion of the positive/negative polarity of grey scale voltage.

9 Claims, 4 Drawing Sheets

(56) References Cited

U.S. PATENT DOCUMENTS

| | | | |
|---|---|---|---|
| 2012/0081352 | A1 | 4/2012 | Yamagishi |
| 2014/0092077 | A1 | 4/2014 | Kim et al. |

FOREIGN PATENT DOCUMENTS

| | | | |
|---|---|---|---|
| JP | 2012-78415 | A | 4/2012 |
| KR | 20070073118 | A | 7/2007 |
| KR | 20090026021 | A | 3/2009 |
| KR | 20140043200 | A | 4/2014 |

OTHER PUBLICATIONS

Korean Office Action dated Jun. 16, 2014; Appln. No. 10-2013-0087288.

EPO Office Action Appln. No. 13 179 441.4-1904 ; Dated Jun. 16, 2015.

Second Korean Office Action dated Mar. 2, 2015; Appln. No. 10-2013-0087288.

Korean Notice of Allowance dated Sep. 28, 2015; Appln. No. 10-2013-0087288.

* cited by examiner

COMMON ELECTRODE VOLTAGE COMPENSATING METHOD, APPARATUS AND TIMING CONTROLLER

FIELD OF INVENTION

The present invention relates to the field of liquid crystal display, and in particular, to a common electrode voltage compensating method, apparatus and a timing controller.

BACKGROUND

With the development of photoelectric display technology, the application field of flat-panel display devices is increasingly broadened. At present, given its characteristics as being long life span, high luminous efficacy, low radiation and low power consumption etc., the liquid crystal display (LCD) becomes a mainstream research target among display device products in recent years. As far as LCD is concerned, to ensure that the display picture is normally displayed, a voltage difference between a common electrode voltage and a grey scale voltage is utilized to display pixel grey scale, wherein different grey scales are represented by different voltage differences.

However, the inventor of the present application has found during his/her research that in the prior art, in order to prevent the crystal liquid molecule from being polarized, the grey scale voltage needs to be driven by an alternating current (AC), and when the positive/negative polarity of the grey scale voltage is reversed, such reversion effect would result in a fluctuation of the common electrode voltage within the display panel due to coupling, which leads to shifting of the grey scale actually displayed, and thus has influence on the display effect of the LCD panel.

SUMMARY

The technical problem to be solved by embodiments of the present invention is to provide a common electrode voltage compensating method, apparatus and a timing controller, which address the problem in the prior art where display picture pixels grey scale is shifted due to a reversion of the positive/negative polarity of a grey scale voltage, by compensating the common electrode voltage, and thus enhance the display effect of the LCD.

To solve the above-mentioned technical problem, the following technical solutions are utilized in the embodiments of the present invention.

According to one aspect of the present invention, a common electrode voltage compensating method comprises:

making statistics for grey scale data of every pixel for displaying a display picture;

calculating a grey scale shifting rate between two adjacent rows of pixels, and obtaining common electrode voltage compensation signal parameters based on the grey scale shifting rate;

generating the positive/negative polarity information of the common electrode voltage compensation signal parameters based on a pixel voltage polarity inversion signal;

generating a common electrode voltage compensation control signal based on the common electrode voltage compensation signal parameters and the positive/negative polarity thereof, to cause a common electrode generating unit to generate a common electrode input voltage having a waveform of a compensation voltage based on the common electrode voltage compensation control signal.

Further, calculating the grey scale shifting rate between two adjacent rows of the pixels comprises:

accumulating the grey scale data of pixels in each row to obtain a summation of the grey scale data for every row of pixels;

calculating the grey scale shifting rate between two adjacent rows of pixels based on the respective summations of the grey scale data of two adjacent rows of pixels.

Further, calculating the grey scale shifting rate between two adjacent rows of the pixels based on the respective summations of the grey scale data of two adjacent rows of pixels comprises:

calculating a maximum absolute value N of difference values, each of which is calculated between the respective summations of the grey-scale data for every two rows of pixels, wherein $N=(2^n-1)\times j$, j is column number of the pixels in the display picture and n is colour depth bit number of the display picture;

calculating the difference value $(A_{i+1}-A_i)$ between the respective summations of the grey scale data of two adjacent rows of pixels, wherein i is row number of the pixels, i=1, 2, 3, 4 . . . ;

deciding whether positive/negative properties of Ai+1 and Ai are the same;

if the positive/negative properties are the same, then the grey scale shifting rate between the $i^{th}$ row and the $(i+1)^{th}$ row of pixels is $$B_{i+1} = \frac{|A_{i+1} - A_i|}{N},$$

if the positive/negative properties are different, then the grey scale shifting rate between the $i^{th}$ row and the $(i+1)^{th}$ row of pixels is $$B_{i+1} = 1 - \frac{|A_{i+1} - A_i|}{N}.$$

Further, generating positive/negative polarity information of the common electrode voltage compensating signal parameters based on a pixel voltage polarity inversion signal comprises:

when a waveform of the pixel voltage polarity inversion signal is of an upward trend, the polarity of the common electrode voltage compensation signal parameters is negative;

when the waveform of the pixel voltage polarity inversion signal is of an downward trend, the polarity of the common electrode voltage compensation signal parameters is positive.

Further, the waveform of the compensation voltage is any one from a triangle waveform, a rectangular waveform, a sine wave waveform and an exponential waveform.

According to a further aspect of the present invention, a timing controller comprises:

a data processor, making statistics for grey scale data of every pixel for displaying a display picture;

a compensation data calculator, calculating a grey scale shifting rate between two adjacent rows of pixels, obtaining common electrode voltage compensation signal parameters based on the grey-level shifting rate, and generating positive/negative polarity information of the common electrode voltage compensation signal parameters based on a pixel voltage polarity inversion signal; and a common electrode voltage compensation signal generator, generating a common electrode voltage compensation control signal based on the common electrode voltage compensation signal parameters and the positive/negative polarity thereof, to cause a common electrode generating unit to generate a common electrode input voltage having a waveform of a compensation voltage based on the common electrode voltage compensation control signal.

Further, the compensation data calculator is configured to:

accumulate the grey scale data of pixels in each row to obtain a summation of the grey scale data for every row of pixels;

calculate the grey scale shifting rate between two adjacent rows of pixels based on the respective summations of the grey scale data of two adjacent rows of pixels.

Further, the compensation data calculator is configured to:

when a waveform of the pixel voltage polarity inversion signal is of an upward trend, determine the polarity of the common electrode voltage compensation signal parameters is negative; when the waveform of the pixel voltage polarity inversion signal is of an downward trend, determine the polarity of the common electrode voltage compensation signal parameters is positive.

Further, the waveform of the compensation voltage is any one from a triangle waveform, a rectangular waveform, a sine wave waveform and an exponential waveform.

According to still a further aspect of the present invention, a common electrode voltage compensating apparatus comprises a timing controller and a common electrode voltage generating unit.

The timing controller is configured to make statistics for grey scale data of every pixel for displaying a display picture, calculate a grey scale shifting rate between two adjacent rows of pixels, obtain common electrode voltage compensation signal parameters based on the grey-level shifting rate, generate positive/negative polarity information of the common electrode voltage compensation signal parameters based on a pixel voltage polarity inversion signal, and generate a common electrode voltage compensation control signal based on the common electrode voltage compensation signal parameters and the positive/negative polarity thereof.

The common electrode voltage generating unit is configured to generate a common electrode input voltage having a waveform of a compensation voltage based on the common electrode voltage compensation control signal.

Further, the common electrode voltage compensating apparatus further comprises a voltage output maintaining unit for improving loading capacity of the common electrode input voltage and generating a common electrode output voltage.

A common electrode voltage compensating method, apparatus and a timing controller according to the embodiment of the present invention calculate and generate the common electrode compensation voltage, whereby the voltage difference between the common electrode voltage and the grey scale voltage of the display apparatus is kept stable/stabilized, the accuracy of the display picture pixel grey scale is guaranteed, and the display effect of the liquid crystal display panel is improved.

BRIEF DESCRIPTION OF THE DRAWINGS

The drawings used in the description of the embodiments will now be briefly illustrated, in order to show the technical solutions of the embodiments of the present invention or of the prior art more clearly. Apparently, the drawings in the following descriptions are only some embodiments of the present invention, and for those skilled in the art, further drawings may be acquired based on these drawings without any creative jobs.

DETAILED DESCRIPTION

An embodiment of the present invention provides a common electrode voltage compensating method, apparatus and a timing controller. A phenomenon of display picture pixel grey scale shifting due to a reversion of the positive/negative polarity of a grey scale voltage is prevented by compensating the common electrode voltage.

In the following descriptions, specific details such as a particular system structure, interface and technology and the like are set out for the purpose of illustrating instead of limiting the present invention, so as to make the present invention be thoroughly understood. However, it is appreciated by a person skilled in the art that the present invention may be implemented in other embodiments without these specific details. In other cases, detailed explanations to the known apparatus, circuit and method are ignored to avoid unnecessary details obscuring the description of the present invention.

Figure 1:
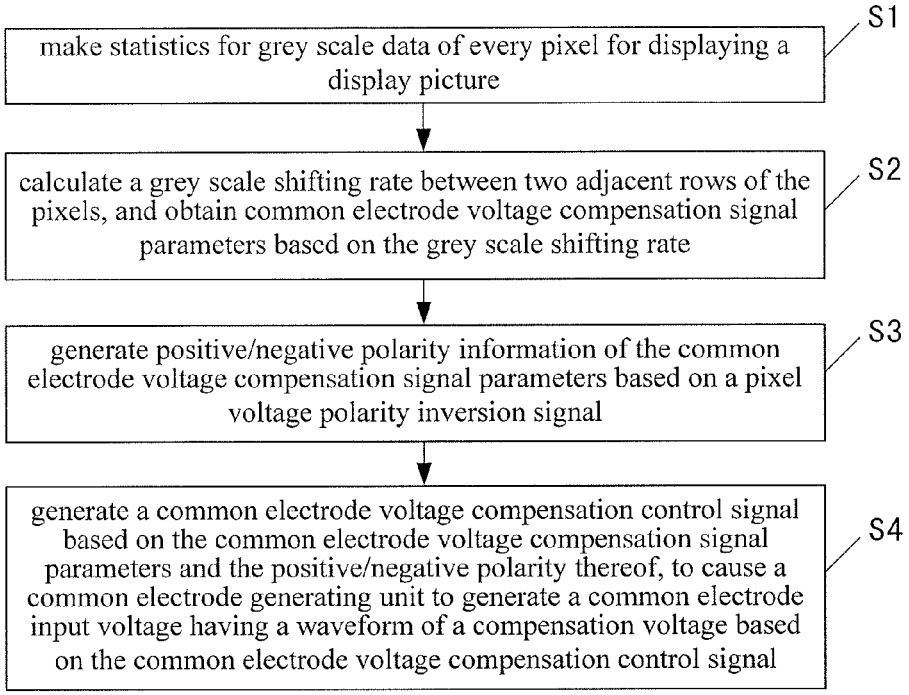
FIG. 1 is a flow chart of a common electrode voltage compensating method according to an embodiment of the present invention.

As shown in FIG. 1, the present invention provides a common electrode voltage compensating method as follows.

At step S1, statistics is made for grey scale data of every pixel for displaying a display picture.

The method of the present embodiment is suitable for a LCD apparatus utilizing AC driving manner. Hereafter, the principle and procedure of the method will be explained in detail by taking a LCD apparatus utilizing point-reversion driving manner as an example. In addition, the method of the present invention is also suitable for a liquid crystal panel utilizing other driving manner such as row-reversion driving manner etc.

An characteristic of the AC driving manner of a LCD apparatus is that, with respect to displaying, a grey scale voltage used for displaying at a certain moment is opposite in polarity to another grey scale voltage used for displaying at a next moment. In which, the positive/negative polarity of the grey scale voltage depends on POL (Polarity Input, pixel voltage polarity inversion signal). With the high and low variations of the POL waveform, the positive/negative polarity of the grey scale voltage may have a reversion change.

Figure 6:
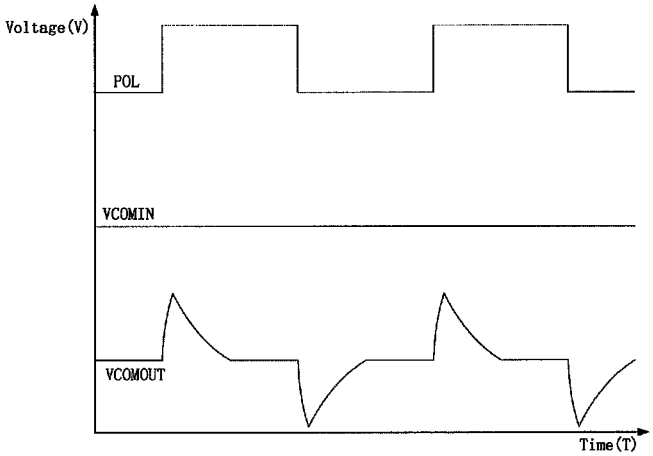
FIG. 6 shows a schematic waveform diagram where the common electrode voltage is not compensated according to the embodiment of the present invention.

When a common electrode output voltage (VCOM OUT) is not coupled to the liquid crystal panel (i.e. no-load status), the waveform of a common electrode input voltage (VCOM IN) is exactly same as that of the common electrode output voltage (VCOM OUT), with a voltage output maintaining unit being used for improving the loading capacity of the electrode voltage signal and having no effect on the waveform. When the common electrode output voltage (VCOM OUT) is coupled to the liquid crystal panel (i.e. load status), its waveform is as shown in FIG. 6, wherein the horizontal axis represents time, the vertical axis represents voltage value, POL is the waveform of the polarity inversion signal of the pixel voltage, VCOM IN is the input waveform of the common electrode voltage, and VCOM OUT is the output waveform of the common electrode voltage. It can be seen from FIG. 6, because there is a capacitor coupling, the high and low variations in POL waveform result in fluctuations in VCOM OUT, which makes the voltage difference shift.

Figure 7:
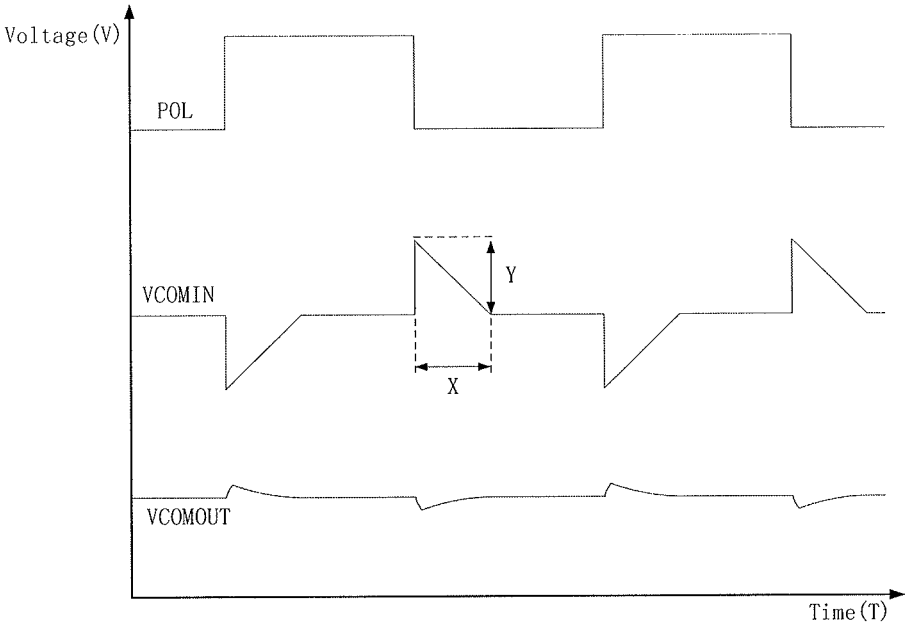
FIG. 7 shows a schematic waveform diagram where the compensation common electrode voltage waveform according to the embodiment of the present invention is a triangle waveform.

As shown in FIG. 7, with an embodiment of the present invention, a common electrode input voltage having compensation voltage waveform is utilized, so as to compensate VCOM IN in terms of voltage waveform, and thus keep VCOM OUT relatively stable in the load status.

In this embodiment, a data processor of a timing controller is used to make statistics for the grey scale data of every pixel for displaying picture. Giving an example, Table 1 is the grey scale data table of every pixel as the statistic result of the data processor. As illustrated in Table 1, the grey scale data table comprises the grey scale data of every pixel.

TABLE 1

| Row number | Grey scale data | | | | | | | |
|---|---|---|---|---|---|---|---|---|
| the $1^{st}$ row | +127 | −32 | +96 | −45 | +255 | −64 | +77 | −12 |
| the $2^{nd}$ row | −78 | +65 | −76 | +49 | −28 | +0 | −77 | +12 |
| the $3^{rd}$ row | +45 | −244 | +235 | −64 | +128 | −132 | +66 | −143 |
| the $4^{th}$ row | −38 | +96 | −56 | +154 | −128 | +5 | −59 | +49 |
| . . . | | | | . . . | | | | |
| the $i^{th}$ row | | | | . . . | | | | |

At step S2, a grey scale shifting rate between two adjacent rows of pixels is calculated, and common electrode voltage compensation signal parameters are obtained based on the grey scale shifting rate.

Figure 2:
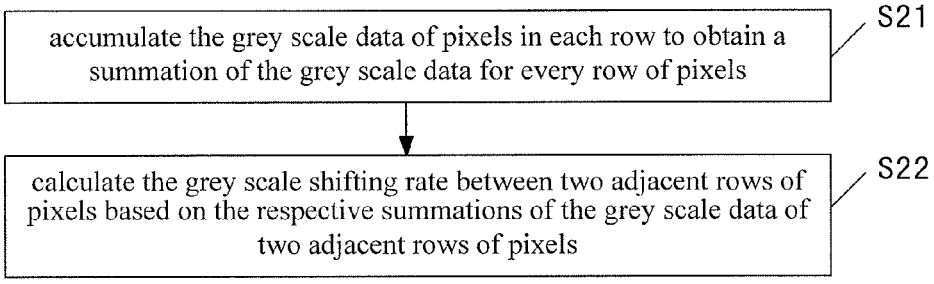
FIG. 2 is a first flow chart for calculating a grey scale shifting rate between two adjacent rows of pixels according to the embodiment of the present invention.

A compensation data calculator of the timing controller is used for calculating the grey scale shifting rate between two adjacent rows of pixels. Specifically, as shown in FIG. 2, calculating the grey scale shifting rate between two adjacent rows of pixels comprises the following steps.

At step S21, the grey scale data of pixels in each row is accumulated to obtain a summation of the grey scale data for every row of pixels.

The compensation data calculator is used for accumulating each pixel grey scale data in one row to obtain a summation $A_i$ of the grey scale data of the row of pixels. As shown in Table 1, i is the row number of pixels, $A_i$ is the summation of grey scale data for the $i^{th}$ row of pixels. For example, summation $A_1$ of the grey scale data "+127, −32, +96, −45, +255, −64, +77, −12" of the first row is +402.

At step S22, the grey scale shifting rate between two adjacent rows of pixels is calculated based on the respective summations of the grey scale data of two adjacent rows of pixels.

Figure 3:
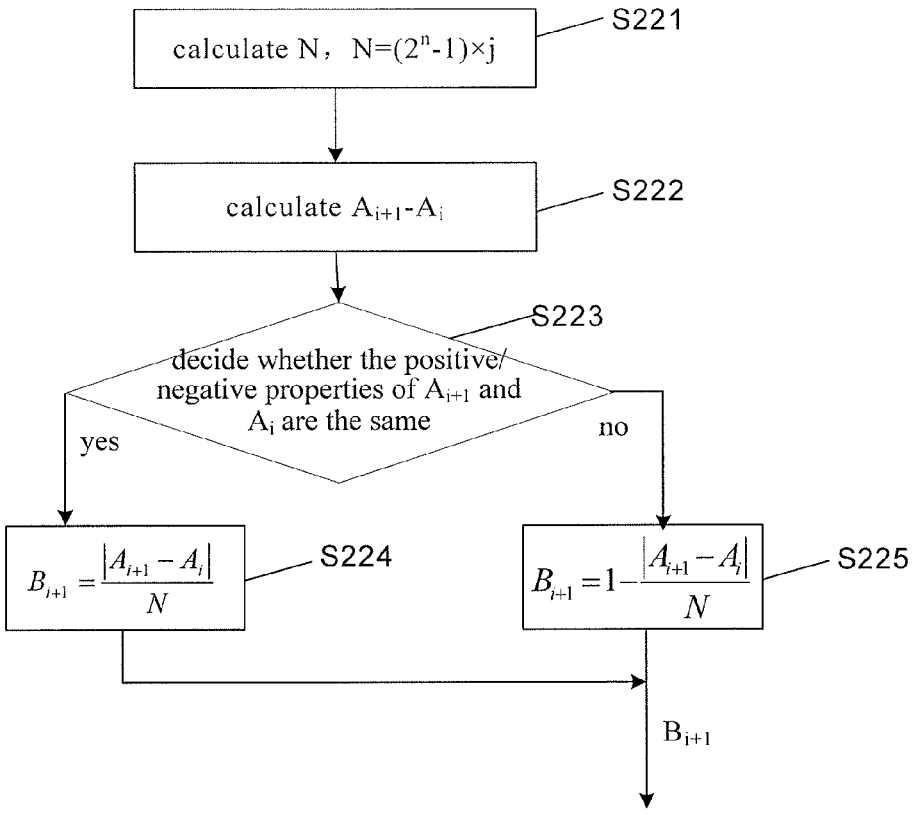
FIG. 3 is a second flow chart for calculating the grey scale shifting rate between two adjacent rows of pixels according to the embodiment of the present invention.

The compensation data calculator calculates the grey scale shifting rate between two adjacent rows of pixels based on the respective summations of the grey scale data of two adjacent rows of pixels. For example, $B_{i+1}$ is the grey scale shifting rate between the $i^{th}$ row and the $(i+1)^{th}$ row of pixels, and is calculated from $A_i$ and $A_{i+1}$. Specifically, as shown in FIG. 3, the step S22 comprises the following sub-steps:

At step S221, a maximum absolute value N of difference values is calculated, each difference value is a difference between the respective summations of the grey-scale data of two rows of pixels, wherein $N=(2^n-1)\times j$, j is column number of the pixels in the display picture and n is colour depth bit number of the display picture;

For example, when the color depth bit number of the display device n is 8, and column number j is 8, the compensation data calculator yields N=2040.

At step S222, the difference value $(A_{i+1}-A_i)$ between the respective summations of the grey scale data of two adjacent rows of pixels is calculated, wherein i is the row number of the pixels, i=1, 2, 3, 4 . . . .

The compensation data calculator calculates the difference value between the respective summations of two adjacent rows of pixels. For example, as shown in Table 1, $A_2-A_1=-133-(+402)=-535$.

At step S223, the positive/negative properties of $A_i$ and $A_{i+1}$ are decided, and if the two have the same property, then step S224 is performed; if the two have different property, then step S225 is performed.

The compensation data calculator decides whether the positive/negative properties of the respective summations of the grey scale data of two adjacent rows of pixels are the same. For example, as shown in Table 1, $A_2$ is negative and $A_3$ is negative, so the two have the same property (i.e. negative), then step S224 is performed; while $A_1$ is positive and $A_2$ is negative, so the two have different properties, then step S225 is performed.

At step S224, the grey scale shifting rate between the $i^{th}$ row and the $(i+1)^{th}$ row of pixels is calculated as $$B_{i+1} = \frac{|A_{i+1} - A_i|}{N},$$

wherein i is the row number of pixels, $A_i$ is the summation of the grey scale data of the $i^{th}$ row of pixels, $A_{i+1}$ is the summation of the grey scale data of the $(i+1)^{t1}$ row of pixels, N is the maximum absolute value of the difference values, each difference value is a difference between the respective summations of the grey-scale data of two rows of pixels, and $B_1+_1$ is the grey scale shifting rate between the $i^{th}$ row and the $(i+1)^{th}$ row of pixels.

The compensation data calculator calculates the grey scale shifting rate between two adjacent rows of pixels based on the respective summations of the grey scale data of two adjacent rows of pixels. For example, as shown in Table 1, as $A_2$ a negative value and $A_3$ is a negative value, the two have the same property, so $$B_3 = \frac{|A_3 - A_2|}{N} = \frac{|(-109) - (-133)|}{2040} = 0.01176 \approx 0.$$

As one specific implementation of the present invention, the calculated $B_{i+1}$ is rounded to one decimal. Besides, the grey scale shifting rate can be rounded to more decimals in order to improve the accuracy of the algorithm.

At step S225, the grey scale shifting rate between the $i^{th}$ row and the $(i+1)^{th}$ row of pixels is calculated as $$B_{i+1} = 1 - \frac{|A_{i+1} - A_i|}{N},$$

wherein i is the row number of pixels, $A_i$ is the summation of the grey scale data for the $i^{th}$ row of pixels, $A_{i+1}$ is the summation of the grey scale data for the $(i+1)^{th}$ row of pixels, N is the maximum absolute value of the difference values, each difference value is a difference between the respective summations of the grey-scale data of two rows of pixels, and $B_{i+1}$ is the grey scale shifting rate between the $i^{th}$ row and the $(i+1)^{th}$ row of pixels.

The compensation data calculator calculates the grey scale shifting rate between two adjacent rows of pixels based on the respective summations of grey scale data of two adjacent rows of pixels. For example, as shown in Table 1, as $A_1$ is a positive value and $A_2$ is a negative value, the two have different properties, so $$B_2 = 1 - \frac{|A_2 - A_1|}{N} = 1 - \frac{|(-33) - 402|}{2040} = 0.73744 \approx 0.7.$$

As one specific implementation of the present invention, the calculated $B_{1+1}$ is rounded to one decimal. Besides, the grey scale shifting rate can be rounded to more decimals in order to improve the accuracy of the algorithm.

The compensation data calculator of the timing controller obtains common electrode voltage compensation signal parameters based on the grey scale shifting rate. In specific, as shown in FIG. 6, the timing controller makes statistics for the fluctuated waveform of VCOM OUT where no compensation signal is included, and makes quantitative analysis, so as to obtain the wave-peak-value of the VCOM OUT waveform and the duration time of the VCOM OUT fluctuation, which make up a set of parameter values. Then, the timing controller calculates the grey scale shifting rate at a grey scale voltage jumping timing based on the jumping grey scale voltage causing the VCOM OUT fluctuations. The timing controller makes statistics for the parameter values and the grey scale shifting rate, and establishes the correspondence between the parameter values and the grey scale shifting rate to generate a lookup table as shown in FIG. 2, wherein $B_{1+1}$ represents the grey scale shifting rate, and X, Y represent a set of parameter values derived from the quantitative analysis of VCOM OUT waveform signal.

TABLE 2

| | | | | | | | | | | | |
|---|---|---|---|---|---|---|---|---|---|---|---|
| $B_{i+1}$ | 0.0 | 0.1 | 0.2 | 0.3 | 0.4 | 0.5 | 0.6 | 0.7 | 0.8 | 0.9 | 1.0 |
| Y | 0.0 | 0.1 | 0.2 | 0.3 | 0.4 | 0.5 | 0.6 | 0.7 | 0.8 | 0.9 | 1.0 |
| X | 0.0 | 0.1 | 0.1 | 0.2 | 0.3 | 0.3 | 0.4 | 0.5 | 0.6 | 0.7 | 0.7 |

Next, the compensation data calculator receives the data values of the grey scale shifting rates, and obtains the VCOM IN compensation signal parameters X, Y based on the correspondence between the parameter values and the grey scale shifting rate in Table 2. As shown in FIG. 7, Y represents the peak value of the compensation signal waveform in VCOM IN, and X represents the duration time of the compensation signal waveform in VCOM IN.

At step S3, the positive/negative polarity information of the common electrode voltage compensation signal parameters is generated based on pixel voltage polarity inversion signal.

The compensation data calculator of the timing controller generates the positive/negative polarity information of the common electrode voltage compensation signal parameters based on the pixel voltage polarity inversion signal. In the embodiment of the present invention, the change in POL causes the grey scale voltage polarity (positive or negative) to reverse, which further results in the fluctuation of VCOM OUT. In order to keep the VCOM OUT waveform in the load status relatively stable, the waveform direction of the compensation voltage should be opposite to the fluctuation direction of the VCOM OUT. The fluctuation direction of the VCOM OUT depends on the waveform of the pixel voltage polarity reversion signal.

Further, generating the positive/negative polarity information of the common electrode voltage compensation signal parameters based on the pixel voltage polarity inversion signal comprises: when the waveform of the pixel voltage polarity inversion signal is of an upward trend, the polarity of the common electrode voltage compensation signal parameters is negative; when the waveform of the pixel voltage polarity inversion signal is of an downward trend, the polarity of the common electrode voltage compensation signal parameters is positive.

Specifically, as shown in FIG. 7, when the liquid crystal apparatus is displaying the first and second row, POL generates a change having the upward trend, which causes the grey scale voltage to jump from negative polarity to positive polarity, at the same time, the VCOM OUT will generate a fluctuation in the positive direction, so Y should be set as negative to ensure the waveform direction of the compensation voltage is at the negative direction, so that the waveform of the VCOM OUT is kept relatively stable; similarly, when the POL is of the downward trend, the VCOM OUT will generate a fluctuation in the negative direction, so the waveform of the compensation voltage should be at the positive direction, i.e. the parameter Y should be set at positive.

Further, the waveform of the compensation voltage may be any one from a triangle waveform, a rectangular waveform, a sine wave waveform and an exponential waveform.

As a specific implementation of the present invention, as shown in FIG. 7, the common electrode voltage compensation signal parameters X, Y and the positive/negative polarity of the common electrode voltage compensation signal parameter Y are used to determine the waveform of the VCOM IN compensation voltage. When the compensation voltage waveform generated by the common electrode voltage generating unit is a triangle waveform, X is a length of the bottom line of the triangle waveform, Y is a height of the triangle waveform, and the positive/negative property of Y decides the orientation of the triangle waveform. It should be noted that, the waveform of the compensation voltage can also be a common voltage waveform, such as a rectangular waveform, a sine wave waveform or an exponential waveform, and the setting of the waveform parameters can also be properly adjusted according to actual needs, thus the waveform and the parameters thereof are not defined herein.

At step S4, a common electrode voltage compensation control signal is generated based on the common electrode voltage compensation signal parameters and the positive/negative polarity thereof, so that the common electrode generating unit generates the common electrode input voltage having a compensation voltage waveform based on the common electrode voltage compensation control signal.

The common electrode voltage compensation control signal generator receives the common electrode voltage compensation signal parameters and the positive/negative polarity thereof, and encapsulates the above information into common electrode voltage compensation control signal that can be identified by the common electrode voltage generating unit. The common electrode voltage generating unit can generate common electrode voltage with compensation signal through the common electrode voltage compensation control signal.

The common electrode voltage compensating method according to the embodiment of the present invention calculates and generates the common electrode compensation voltage, thereby the voltage difference between the common electrode voltage and the grey scale voltage of the display apparatus is kept stabilized, the accuracy of the display picture pixel grey scale is guaranteed, and the display effect of the liquid crystal display panel is improved.

In the embodiment of the present invention, the specific implementations of respective steps, particularly the descriptions regarding the compensation voltage waveform and the common electrode voltage compensation signal parameters, are only exemplary illustrations other than limitations to the technical solution. Those skilled in the art should appreciate that in practice, settings and selections may be made according to actual needs, in other words, various generating manners may be provided for the compensation voltage waveform and common electrode voltage compensation signal parameters, in order to complete all or part of the functions as described above. The detailed procedures of the above described generating method and manner may be referred to the corresponding procedures in the above described method implementations and so will not be repeated here. The listed cases in the embodiments are only preferred ones.

Figure 4:
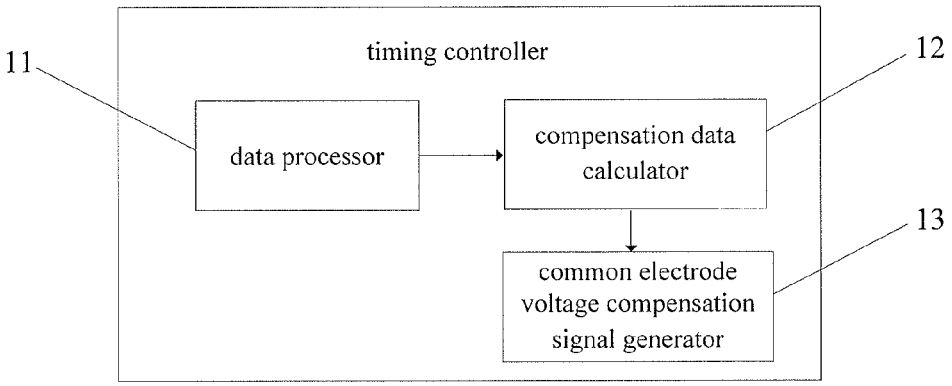
FIG. 4 is a schematic structure diagram of a timing controller according to the embodiment of the present invention.

An embodiment of the present invention also provides a timing controller, as shown in FIG. 4, comprising:

a data processor 11, for making statistics for grey scale data of every pixel for displaying a display picture;

a compensation data calculator 12, for calculating a grey scale shifting rate between two adjacent rows of pixels, obtaining common electrode voltage compensation signal parameters based on the grey-level shifting rate, and generating the positive/negative polarity information of the common electrode voltage compensation signal parameters based on a pixel voltage polarity inversion signal; and a common electrode voltage compensation signal generator 13, for generating a common electrode voltage compensation control signal based on the common electrode voltage compensation signal parameters and the positive/negative polarity thereof, to cause a common electrode generating unit to generate a common electrode input voltage having a waveform of a compensation voltage based on the common electrode voltage compensation control signal.

In particular, the data processor 11 is used for:

accumulating the grey scale data of pixels in each row to obtain a summation of the grey scale data for every row of pixels;

calculating the grey scale shifting rate between two adjacent rows of pixels based on the respective summations of the grey scale data of two adjacent rows of pixels.

Further, the waveform of the compensation voltage is any one from a triangle waveform, a rectangular waveform, a sine wave waveform and an exponential waveform.

The operating principle of the timing controller is similar with that of the above described embodiment and will not be repeated here.

The timing controller according to the embodiment of the present invention sets the data processor, the compensation data calculator and the common electrode voltage compensation signal generator to calculate and generate the common electrode compensation voltage, whereby the voltage difference between the common electrode voltage and the grey scale voltage of the display apparatus is kept stable, the accuracy of the display picture pixel grey scale is guaranteed, and the display effect of the liquid crystal display panel is improved.

Figure 5:
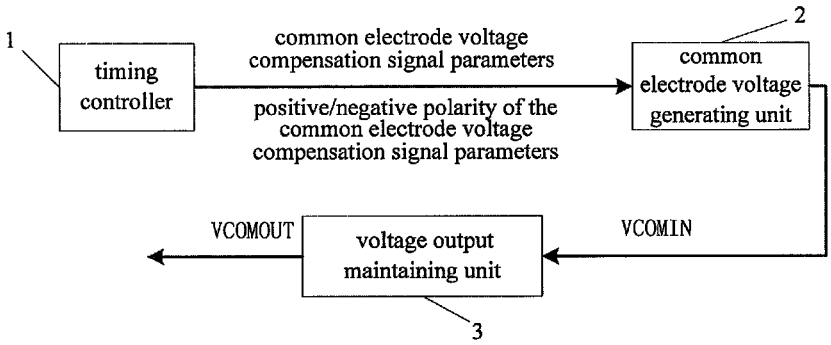
FIG. 5 is a schematic structure diagram of a common electrode voltage compensating apparatus according to the embodiment of the present invention.

In addition, an embodiment according to the present invention further provides a common electrode voltage compensating apparatus, as shown in FIG. 5, comprising: a timing controller and a common electrode voltage generating unit.

The timing controller 1 is used for making statistics for grey scale data of every pixel for displaying a display picture, calculating a grey scale shifting rate between two adjacent rows of pixels, obtaining common electrode voltage compensation signal parameters based on the grey scale shifting rate, generating positive/negative polarity information of the common electrode voltage compensation signal parameters based on a pixel voltage polarity inversion signal, and generating a common electrode voltage compensation control signal based on the common electrode voltage compensation signal parameters and the positive/negative polarity thereof.

The common electrode voltage generating unit 2 is used for generating a common electrode input voltage having a waveform of a compensation voltage based on the common electrode voltage compensation control signal.

Specifically, the common electrode voltage compensating apparatus further comprises a voltage output maintaining unit 3. The voltage output maintaining unit 3 is used for improving the loading capacity of the common electrode input voltage, and for generating a common electrode output voltage.

The operating principle of the common electrode voltage compensating apparatus is similar with that of the above described embodiment and thus will not be repeated here. In addition, structures of other parts of the common electrode voltage compensating apparatus may refer to the prior art and will not be repeated here.

The common electrode voltage compensating apparatus according to the embodiment of the present invention sets the timing controller, the common electrode voltage generating unit and the voltage output maintain unit to generate the common electrode compensation voltage, whereby the voltage difference between the common electrode voltage and the grey scale voltage of the display apparatus is kept stable, the accuracy of the display picture pixel grey scale is guaranteed, and the display effect of the liquid crystal display panel is improved.

The embodiments as described above are only specific implementations of the present invention and the protection scope of the present invention is not limited thereto. Within the technical scope of the present invention, anyone skilled in the art of the present invention may readily conceive of modifications and substitutes, which should be encompassed in the protection scope of the present invention. Therefore, the protection scope of the present invention is subject to the appended claims.

What is claimed is:

1. A common electrode voltage compensating method, comprising:

making statistics for grey scale data of every pixel for displaying a display picture;

accumulating the grey scale data of pixels in each row to obtain a summation of the grey scale data for every row of pixels, and calculating a grey scale shifting rate between two adjacent rows of the pixels based on the respective summations of the grey scale data of two adjacent rows of pixels;

obtaining common electrode voltage compensation signal parameters based on the grey scale shifting rate;

generating positive/negative polarity information of the common electrode voltage compensation signal parameters based on a pixel voltage polarity inversion signal;

generating a common electrode voltage compensation control signal based on the common electrode voltage compensation signal parameters and the positive/negative polarity thereof, to cause a common electrode generating unit to generate a common electrode input voltage having a waveform of a compensation voltage based on the common electrode voltage compensation control signal, wherein calculating the grey scale shifting rate between two adjacent rows of the pixels based on the respective summations of the grey scale data of two adjacent rows of pixels comprises:

calculating a maximum absolute value N of difference values, each of which is calculated between the respective summations of the grey-scale data for every two rows of pixels, wherein $N=(2^n-1)\times j$, j is column number of the pixels in the display picture and n is colour depth bit number of the display picture;

calculating the difference value $(A_{i+1}-A_i)$ between the respective summations of the grey scale data of two adjacent rows of pixels, wherein i is row number of the pixels, i=1, 2, 3, 4 . . . ;

deciding whether positive/negative properties of $A_{i+1}$ and $A_i$ are the same; and determining the grey scale shifting rate between the $i^{th}$ row and the $(i+1)^{th}$ row of pixels is $$B_{i+1} = \frac{|A_{i+1} - A_i|}{N}$$

if the positive/negative properties are the same, and determining the grey scale shifting rate between the $i^{th}$ row and the $(i+1)^{th}$ row of pixels is $$B_{i+1} = 1 - \frac{|A_{i+1} - A_i|}{N}$$

if the positive/negative properties are different.

2. The common electrode voltage compensating method according to claim 1, wherein generating positive/negative polarity information of the common electrode voltage compensating signal parameters based on a pixel voltage polarity inversion signal comprises:

when a waveform of the pixel voltage polarity inversion signal is of an upward trend, the polarity of the common electrode voltage compensation signal parameters is negative;

when the waveform of the pixel voltage polarity inversion signal is of an downward trend, the polarity of the common electrode voltage compensation signal parameters is positive.

3. The common electrode voltage compensating method according to claim 1, wherein the waveform of the compensation voltage is any one from a triangle waveform, a rectangular waveform, a sine wave waveform and an exponential waveform.

4. A timing controller, comprising:

a data processor, making statistics for grey scale data of every pixel for displaying a display picture;

a compensation data calculator, accumulating the grey scale data of pixels in each row to obtain a summation of the grey scale data for every row of pixels, calculating a grey scale shifting rate between two adjacent rows of pixels based on the respective summations of the grey scale data of two adjacent rows of pixels, obtaining common electrode voltage compensation signal parameters based on the grey-level shifting rate, and generating positive/negative polarity information of the common electrode voltage compensation signal parameters based on a pixel voltage polarity inversion signal; and a common electrode voltage compensation signal generator, generating a common electrode voltage compensation control signal based on the common electrode voltage compensation signal parameters and the positive/negative polarity thereof, to cause a common electrode generating unit to generate a common electrode input voltage having a waveform of a compensation voltage based on the common electrode voltage compensation control signal, wherein calculating the grey scale shifting rate between two adjacent rows of the pixels based on the respective summations of the grey scale data of two adjacent rows of pixels comprises:

calculating a maximum absolute value N of difference values, each of which is calculated between the respective summations of the grey-scale data for every two rows of pixels, wherein $N=(2^n-1)\times j$, j is column number of the pixels in the display picture and n is colour depth bit number of the display picture;

calculating the difference value $(A_{i+1}-A_i)$ between the respective summations of the grey scale data of two adjacent rows of pixels, wherein i is row number of the pixels, i=1, 2, 3, 4 . . . ;

deciding whether positive/negative properties of $A_{i+1}$ and $A_i$ are the same; and determining the grey scale shifting rate between the $i^{th}$ row and the $(i+1)^{th}$ row of pixels is $$B_{i+1} = \frac{|A_{i+1} - A_i|}{N}$$

if the positive/negative properties are the same, and determining the grey scale shifting rate between the $i^{th}$ row and the $(i+1)^{th}$ row of pixels is $$B_{i+1} = 1 - \frac{|A_{i+1} - A_i|}{N}$$

if the positive/negative properties are different.

5. The timing controller according to claim 4, wherein the compensation data calculator is configured to:

accumulate the grey scale data of pixels in each row to obtain a summation of the grey scale data for every row of pixels;

calculate the grey scale shifting rate between two adjacent rows of pixels based on the respective summations of the grey scale data of two adjacent rows of pixels.

6. The timing controller according to claim 4, wherein the compensation data calculator is configured to:

when a waveform of the pixel voltage polarity inversion signal is of an upward trend, determine the polarity of the common electrode voltage compensation signal parameters is negative; when the waveform of the pixel voltage polarity inversion signal is of an downward trend, determine the polarity of the common electrode voltage compensation signal parameters is positive.

7. The timing controller according to claim 4, wherein the waveform of the compensation voltage is any one from a triangle waveform, a rectangular waveform, a sine wave waveform and an exponential waveform.

8. A common electrode voltage compensating apparatus, comprising a timing controller and a common electrode voltage generating unit, the timing controller being configured to make statistics for grey scale data of every pixel for displaying a display picture, accumulate the grey scale data of pixels in each row to obtain a summation of the grey scale data for every row of pixels, calculate a grey scale shifting rate between two adjacent rows of pixels based on a difference of the respective summations of the grey scale data of two adjacent rows of pixels, obtain common electrode voltage compensation signal parameters based on the grey-level shifting rate, generate positive/negative polarity information of the common electrode voltage compensation signal parameters based on a pixel voltage polarity inversion signal, and generate a common electrode voltage compensation control signal based on the common electrode voltage compensation signal parameters and the positive/negative polarity thereof;

the common electrode voltage generating unit being configured to generate a common electrode input voltage having a waveform of a compensation voltage based on the common electrode voltage compensation control signal, wherein calculating the grey scale shifting rate between two adjacent rows of the pixels based on the respective summations of the grey scale data of two adjacent rows of pixels comprises:

calculating a maximum absolute value N of difference values, each of which is calculated between the respective summations of the grey-scale data for every two rows of pixels, wherein $N=(2^n-1)\times j$, j is column number of the pixels in the display picture and n is colour depth bit number of the display picture;

calculating the difference value $(A_{i+1}-A_i)$ between the respective summations of the grey scale data of two adjacent rows of pixels, wherein i is row number of the pixels, i=1, 2, 3, 4 . . . ;

deciding whether positive/negative properties of $A_{i+1}$ and $A_i$ are the same; and determining the grey scale shifting rate between the $i^{th}$ row and the $(i+1)^{th}$ row of pixels is $$B_{i+1} = \frac{|A_{i+1} - A_i|}{N}$$

if the positive/negative properties are the same, and determining the grey scale shifting rate between the $i^{th}$ row and the $(i+1)^{th}$ row of pixels is $$B_{i+1} = 1 - \frac{|A_{i+1} - A_i|}{N}$$

if the positive/negative properties are different.

9. The common electrode voltage compensating apparatus according to claim 8, further comprising a voltage output maintaining unit for improving loading capacity of the common electrode input voltage and generating a common electrode output voltage.

* * * * *